US005795249A

United States Patent [19]

Johnson

[11] Patent Number: 5,795,249

[45] Date of Patent: Aug. 18, 1998

[54] HOLDER FOR GOLF BALL MARKER

[75] Inventor: James A. Johnson, Kenosha, Wis.

[73] Assignee: 4U2C, Inc., Kenosha, Wis.

[21] Appl. No.: 838,961

[22] Filed: Apr. 23, 1997

[51] Int. Cl.[6] ..... A63B 57/00

[52] U.S. Cl. ..... 473/406; 473/285; 224/918

[58] Field of Search ..... 473/285, 284, 473/286, 406, 408; 224/918

[56] References Cited

U.S. PATENT DOCUMENTS

| | | | |
|---|---|---|---|
| 1,528,056 | 3/1925 | Herbert . | |
| 2,178,872 | 11/1939 | Engstrom . | |
| 3,779,559 | 12/1973 | Taylor . | |
| 3,977,674 | 8/1976 | Zeller | 473/285 |
| 4,239,216 | 12/1980 | Bauer | 473/285 |
| 4,380,337 | 4/1983 | DiMatteo | 473/285 |
| 4,822,052 | 4/1989 | Dimmick et al. . | |
| 5,244,204 | 9/1993 | Zeller | 473/285 |
| 5,282,616 | 2/1994 | Stacavich-Notaro | 473/285 |
| 5,351,949 | 10/1994 | Fox et al. | 473/285 |

*Primary Examiner*—Steven B. Wong
*Attorney, Agent, or Firm*—Quarles & Brady

[57] ABSTRACT

A holder for a golf ball marker which can accommodate a marker having a spike portion. The holder is of a one-piece construction with a post member which can fit into an opening in a golf club in a friction-fit manner. The holder permits easy insertion and removal of the golf ball marker, yet firm retention therein.

8 Claims, 2 Drawing Sheets

FIG. 1
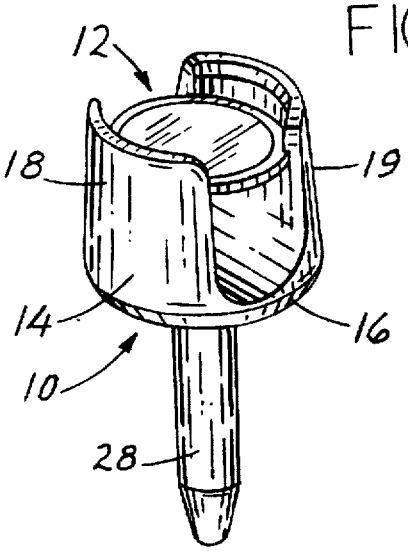
FIG. 2
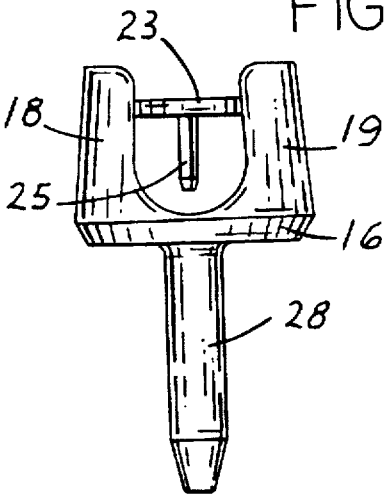
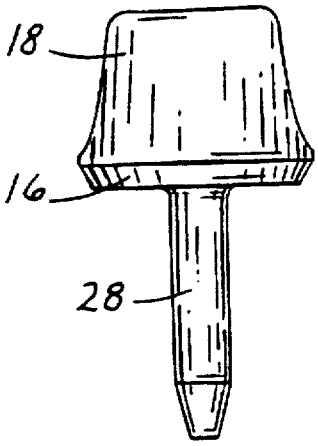
FIG. 3
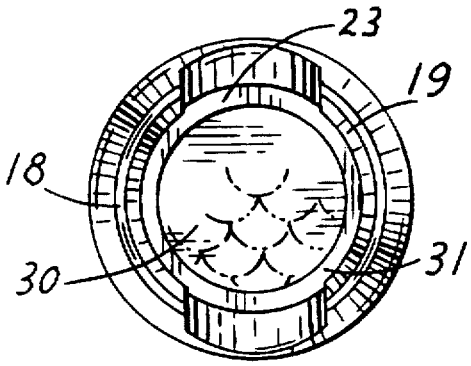
FIG. 4
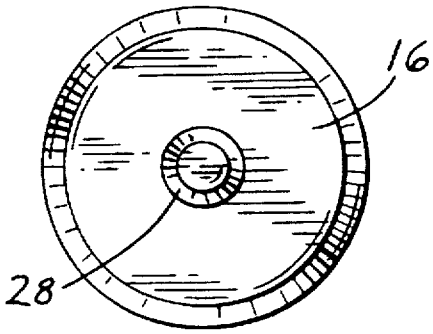
FIG. 5

HOLDER FOR GOLF BALL MARKER

CROSS REFERENCE TO RELATED APPLICATIONS

Not Applicable

STATEMENT REGARDING FEDERALLY SPONSORED RESEARCH

Not Applicable

BACKGROUND OF THE INVENTION

This invention relates to markers for indicating the position of a golf ball. More particularly the invention relates to a holder for the golf ball markers. It is well known to provide a marker device to indicate the position of a golf ball such as on a putting green. In many instances, a golfer will utilize a coin for this purpose. However, in many instances a coin may not be readily available and when it is used, it may not be readily visible. Golf ball markers are disclosed in U.S. Pat. Nos. 1,528,056; 2,178,872 and 5,244,204. These patents show various holders for golf ball markers which can also be attached to a golf club.

In many instances, it is preferable to have a golf ball marker which is not accidentally moved when placed on the turf. Such a marker is one which would have a spike so that it can firmly grip into turf such as on a green.

The prior art does not provide a holder for such a spiked marker. Neither does it provide such a holder which can be easily attached to and removed from a golf club.

SUMMARY OF THE INVENTION

In one aspect, the invention provides a holding device for a golf ball marker, having a body member with a base portion and at least two oppositely positioned arm members extending outwardly from the base portion. A ledge surface is spaced inwardly from the outer edges of each of the arm members with the ledge surfaces being substantially coplanar and adapted to support a golf ball marker. The ledge surfaces and the base portion are constructed and arranged to accommodate a spike portion of a golf ball marker. A fastening member extends from the body member opposite the arm members for engagement with a golf club.

In a preferred form, the holding device has two oppositely positioned arm members, with the arm members constructed and arranged for resilient engagement with the golf ball marker, and the ledge surfaces are spaced from the base portion so that when a portion of the golf ball marker is placed thereon, the spike portion is spaced from the base portion.

In another preferred form, there is a groove in each arm member adjacent to the ledge surfaces.

In yet another preferred form, the fastening member is a post member constructed and arranged for frictional engagement with a golf club top, with the post member and the body member and the arm members all being of a one-piece construction.

In still another preferred form, there is provided a golf ball marker having a disk portion and a spike extending outwardly from the disk portion accommodated in the previously-described holding device.

The objects of the invention therefore include:

a) providing a holding device of the above kind which can accommodate a golf ball marker having a spike portion;

b) providing a holding device of the above kind which can be easily manufactured;

c) providing a holding device of the above kind wherein the golf ball marker can be easily removed but firmly retained;

d) providing a holding device of the above kind which can be firmly attached to a golf club yet easily removed; and e) providing a holding device of the above kind which is aesthetically attractive.

These and still other objects and advantages of the invention will be apparent from the description which follows. In the detailed description below, a preferred embodiment of the invention will be described in reference to the accompanying drawings. This embodiment does not represent the full scope of the invention. Rather, the invention may be employed in other embodiments. Reference should therefore be made to the claims herein for interpreting the breadth of the invention.

DESCRIPTION OF THE DRAWINGS

FIG. 1 is a top perspective view of the holding device with the golf ball marker held therein.

FIG. 2 is a side elevational view.

FIG. 3 is a view similar to FIG. 2, turned 90 degrees.

FIG. 4 is a top plan view of the holding device.

FIG. 5 is a bottom view of the holding device.

DETAILED DESCRIPTION

Figure 6:
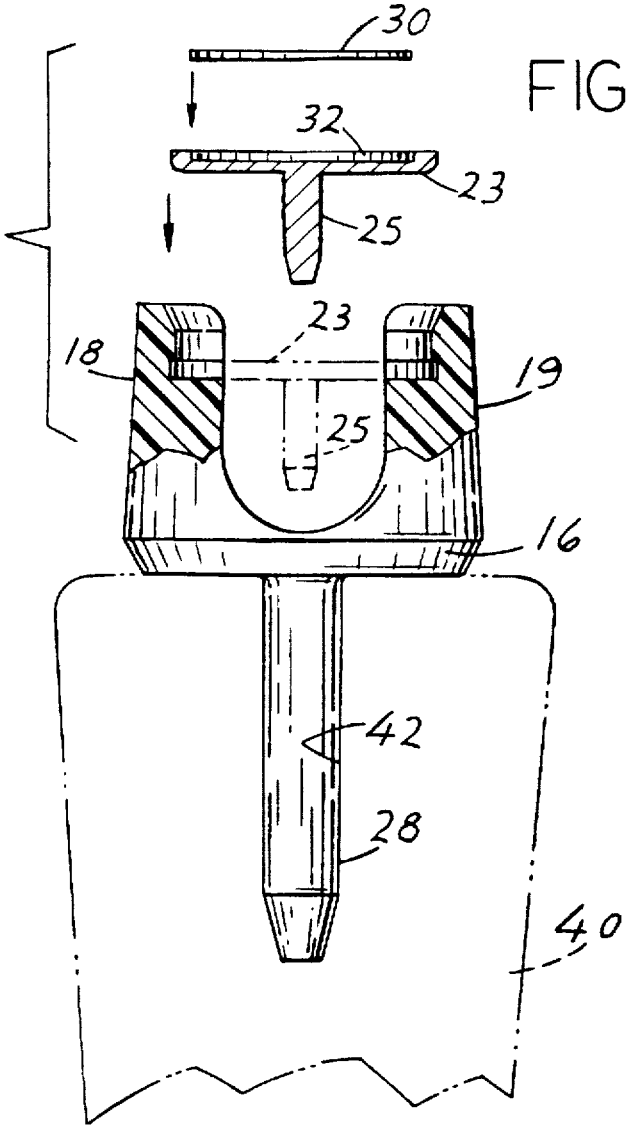
FIG. 6 is an assembly view of the holding device and the golf ball marker with the holding device accommodated on a golf club.

Referring to FIGS. 1–3, the holding device 10 is shown accommodating a golf ball marker 12 therein, the holding device includes a body member 14 with a base portion 16 and two upwardly extending arms 18 and 19. The arms are designed to accommodate and support the disk portion 23 of the golf ball marker 12 therebetween with a spike 25 extending from the disk portion 23 spaced a short distance above the base portion 16.

Referring specifically to FIG. 4, the disk portion 23 includes a highly reflective element 30. This particular element is preferably in the form of a reflective prism material and is available as Witchlite from Witchcraft Tape Products, Inc. This reflective element 30 aids in seeing the marker when it is inserted into the turf such as a golf green.

Figure 7:
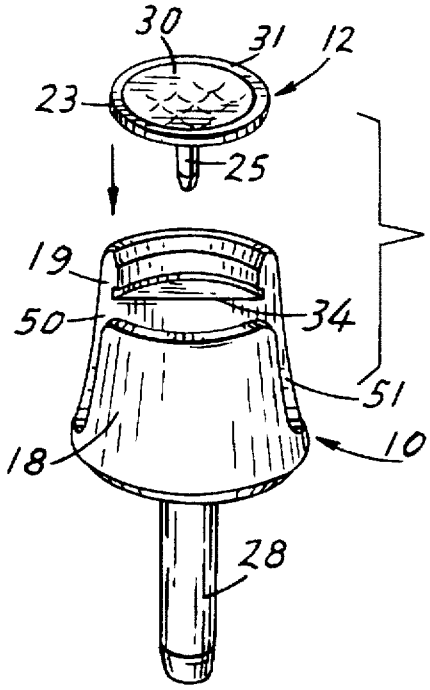
FIG. 7 is an assembly view illustrating an accommodating ledge in the holding device for the golf ball marker.

As seen in FIGS. 5 and 6, a post member 28 extends from the bottom of base portion 16 for frictional engagement in a passage 42 at the top of a golf club handle 40. With reference to FIG. 6, the reflective element 30 is accommodated in a cavity 32 of the disk portion 23. It is retained in the cavity by swaging over a peripheral lip section 31 of the disk portion so as to capture the reflective element therein. This is seen in FIGS. 4 and 7. In a preferred manner, the disk portion 23 as well as the spike 25 is composed of a brass material and is coated with a polyurethane material for protection of the metal.

Figure 8:
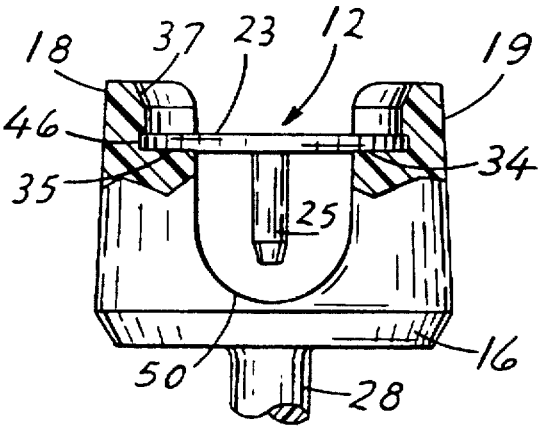
FIG. 8 is an enlarged view and in partial section showing the golf ball marker accommodated in the holding device.
Figure 9:
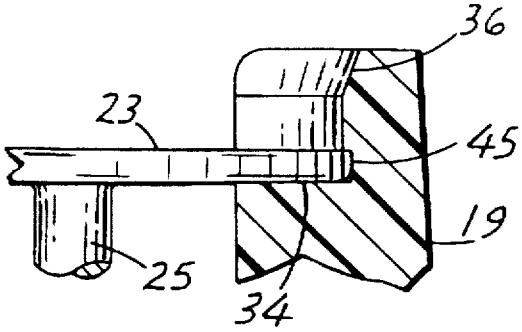
FIG. 9 is an enlarged partial and sectional view showing the disk portion of the golf ball marker accommodated in the holding device.

FIGS. 7–9 illustrate the accommodation of the golf ball marker 12 in the holder 10. There it is seen that the disk portion 23 is accommodated on ledge surfaces 34 and 35. To assure the retention, there is a groove 45 disposed in arm 19, and a similar groove 46 is also placed in arm 18. To facilitate the positioning of the disk 23 into and between the arms 18 and 19, there are the wall tapers 36 and 37. It will be appreciated that the arms 18 and 19 are placed at sufficient distance apart to result in openings 50 and 51. This facilitates an easy gripping of the edge surfaces of the disk portion 23 for removal of the golf ball marker 12 from the holding device 10.

An important feature of the holding device 10 is the fact that it can accommodate a golf ball marker such as 12 with the spike 25. It will be appreciated that the arms 18 and 19 are molded in such a manner that they can provide a slight spreading apart when the disk 23 is positioned between them so as to provide a resilient and frictional engagement therewith. The body 14 as well as the arms 18 and 19 and post member 28 in this instance are preferably molded in a one-piece construction from a nylon plastic material.

In the previous description, the golf ball marker 12 has been illustrated with use of a reflective element 30. The holder device can be utilized with a golf ball marker not having this reflective material although it would not be as efficient to use. While the prism material 30 has been indicated for use in the golf ball marker 12, other reflective materials could be substituted such as Glow & Reflective and Hologram Tape. It will be further appreciated that the reflective element can be used in conjunction with marking identifications such as the logo of a specific company or individual. This could be accomplished with or without the reflective feature. All such and other modifications within the spirit of the invention are meant to be within its scope.

I claim:

1. A holding device for a golf ball marker having a disk portion and a spike extending outwardly from the disk portion comprising:

a body member having a base portion;

at least two oppositely positioned arm members extending outwardly from the base portion;

a ledge surface spaced inwardly from outer edges of each of the arm members, the ledge surfaces being coplanar and constructed and arranged to accommodate the disk portion of the golf marker, the ledge surfaces being spaced from the base portion to accommodate the spike portion of a golf ball marker in a manner so that the spike portion is free of contact from the body member; and a fastening member extending from the body member opposite the arm members for engagement with a golf club.

2. The holding device of claim 1, wherein the ledge surfaces are spaced from the base portion so that when the disk portion of a golf ball marker is placed thereon the spike portion is spaced from the base portion.

3. The holding device of claim 2 wherein there are two oppositely positioned arm members, the arm members constructed and arranged for resilient engagement with the golf ball marker.

4. The holding device of claim 3, wherein there is further included a groove in each arm member adjacent the ledge surfaces.

5. The holding device of claim 1, wherein the fastening member is a post member constructed and arranged for frictional engagement with a golf club top with the post member and body member being of a one-piece construction.

6. The holding device of claim 3, wherein the body members and arm members are of a one-piece construction and composed of a plastic material.

7. A combined holding device and golf ball marker comprising:

a holding device including a body member having a base portion;

at least two oppositely positioned arm members extending outwardly from the base portion;

a ledge surface spaced inwardly from outer edges of each of the arm members, the ledge surfaces being substantially coplanar and adapted to support a golf ball marker;

a fastening member extending from the body member opposite the arm members for engagement with a golf club; and a golf ball marker having a disk portion and a spike extending outwardly from the disk portion seated on the ledge surfaces with the spike spaced from the base portion of the body member as well as free of any contact with the body member.

8. The combined holding device of claim 7, wherein there are two oppositely positioned arm members and the arm members are constructed and arranged to resiliently engage the disk portion of the golf ball marker.

* * * * *